US007144012B2

(12) United States Patent
Grigsby

(10) Patent No.: US 7,144,012 B2
(45) Date of Patent: Dec. 5, 2006

(54) DIEJACK

(76) Inventor: Gail Lee Grigsby, 316 McHenry St., Las Vegas, NV (US) 89144

( * ) Notice: Subject to any disclaimer, the term of this patent is extended or adjusted under 35 U.S.C. 154(b) by 0 days.

(21) Appl. No.: 11/320,118

(22) Filed: Dec. 27, 2005

(65) Prior Publication Data

US 2006/0157935 A1 Jul. 20, 2006

Related U.S. Application Data

(60) Provisional application No. 60/639,710, filed on Dec. 28, 2004.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 4,515,369 A 5/1985 Johnson
5,570,885 A 11/1996 Ornstein
5,651,548 A 7/1997 French
5,695,192 A 12/1997 Brown
5,718,431 A 2/1998 Ornstein
5,782,472 A * 7/1998 Brown ..... 273/274
5,788,574 A 8/1998 Ornstein
5,823,536 A * 10/1998 Flasch ..... 273/292
5,823,879 A 10/1998 Goldberg
5,842,698 A * 12/1998 Brown ..... 273/292
5,851,010 A 12/1998 Feinberg
5,876,283 A 3/1999 Parra
5,924,926 A 7/1999 Brown
5,944,316 A * 8/1999 Hernandez ..... 273/292
5,961,119 A * 10/1999 Brown ..... 273/292
5,961,384 A 10/1999 Robinson
6,019,373 A * 2/2000 Brown ..... 273/274
6,182,968 B1 * 2/2001 Wilkinson ..... 273/292
6,183,366 B1 2/2001 Goldberg
6,203,427 B1 3/2001 Walker
6,264,557 B1 7/2001 Schneier
6,264,560 B1 7/2001 Goldberg
6,379,247 B1 4/2002 Walker
6,398,645 B1 6/2002 Yoseloff
6,450,885 B1 9/2002 Schneier
6,511,072 B1 * 1/2003 Santa Cruz et al. ..... 273/292
6,652,378 B1 11/2003 Cannon
6,679,492 B1 1/2004 Markowiak
6,688,599 B1 * 2/2004 Manalili ..... 273/303
6,692,003 B1 2/2004 Potter
6,712,702 B1 3/2004 Goldberg
6,733,012 B1 * 5/2004 Bui et al. ..... 273/292
6,743,098 B1 6/2004 Urie
6,800,026 B1 10/2004 Cannon
6,846,238 B1 1/2005 Wells
6,860,810 B1 3/2005 Cannon
6,902,481 B1 6/2005 Breckner
6,942,568 B1 9/2005 Baerlocher
6,991,539 B1 1/2006 Pacey (Continued)

*Primary Examiner*—Eugene Kim
*Assistant Examiner*—Dolores R. Collins
(74) *Attorney, Agent, or Firm*—Law Offices of Jams R. Cypher

(57) ABSTRACT

An option in the card game of Blackjack according to which the player pays a fee to buy the option to roll a single die and the outcome, a number between one and six, inclusive, is added to the total point value of the player's cards.

20 Claims, 1 Drawing Sheet

U.S. PATENT DOCUMENTS 7,025,674 B1 4/2006 Adams
2001/0028147 A1 10/2001 Ornstein
2001/0034264 A1* 10/2001 Berman et al. ..... 463/22
2002/0020965 A1 2/2002 Potter
2002/0027322 A1* 3/2002 Breeding et al. ..... 273/292
2002/0077167 A1 6/2002 Merari
2002/0084587 A1 7/2002 Bennett
2002/0096827 A1 7/2002 Markowiak
2002/0111205 A1 8/2002 Beavers
2002/0160834 A1 10/2002 Urie
2002/0183105 A1 12/2002 Cannon
2003/0034608 A1* 2/2003 Bui et al. ..... 273/274
2003/0060247 A1 3/2003 Goldberg
2003/0064801 A1 4/2003 Breckner
2003/0075869 A1* 4/2003 Breeding et al. ..... 273/292
2003/0078103 A1 4/2003 LeMay
2003/0104854 A1 6/2003 Cannon
2003/0109310 A1 6/2003 Heaton
2003/0144049 A1 7/2003 Pacey
2003/0207706 A1 11/2003 Potter
2003/0236110 A1 12/2003 Beaulieu
2004/0000755 A1 1/2004 Cherven
2004/0051247 A1 3/2004 Phillips
2004/0053668 A1 3/2004 Baerlocher
2004/0087357 A1 5/2004 Johnson
2004/0087362 A1 5/2004 Beavers
2004/0106446 A1 6/2004 Cannon
2004/0116173 A1 6/2004 Baerlocher
2004/0160005 A1 8/2004 Krise
2004/0204233 A1 10/2004 Saffari
2004/0242327 A1 12/2004 Shahar
2004/0248634 A1 12/2004 Herrmann
2004/0248659 A1 12/2004 Harned
2004/0254006 A1 12/2004 Lam
2005/0037832 A1 2/2005 Cannon
2005/0054422 A1 3/2005 Rothkranz
2005/0059446 A1 3/2005 Kaminkow
2005/0064945 A1 3/2005 Voden
2005/0101383 A1 5/2005 Wells
2005/0148377 A1 7/2005 Goldberg
2005/0156380 A1 7/2005 Warthen
2005/0164793 A1 7/2005 Merimovich
2005/0181851 A1 8/2005 Amaitis
2005/0212213 A1 9/2005 Inglese
2005/0218591 A1 10/2005 Torigian
2005/0239538 A1 10/2005 Dixon
2005/0245305 A1 11/2005 Asher
2005/0245306 A1 11/2005 Asher
2005/0266919 A1 12/2005 Rowe
2005/0282606 A1 12/2005 Fiden
2006/0019740 A1* 1/2006 Schugar ..... 463/25
2006/0033276 A1 2/2006 Evans
2006/0046821 A1 3/2006 Kaminkow
2006/0046853 A1 3/2006 Black
2006/0068898 A1 3/2006 Maya
2006/0073867 A1 4/2006 Rothkranz
2006/0073875 A1 4/2006 Hedrick
2006/0084485 A1 4/2006 Elias

* cited by examiner

DIEJACK

This application claims the benefit of U.S. Provisional Application No. 60/693,710, filed Dec. 28, 2004.

BACKGROUND OF THE INVENTION

Blackjack is a popular card game typically played in a casino. It is also known by the names "twenty-one" and "pontoon" in British English. It is descended from the card game "vingt-et-un" (trans. "twenty-one"), which originated in French casinos during the 18$^{th}$ century. In the original, there was no bonus paid out for a two-card hand totaling 21 points.

Rules of Blackjack

Blackjack hands are scored according to the point total of the cards in the hand. The hand with the highest total wins as long as it is 21 or less. If the total is greater than 21, it is a called a "bust." Numbered cards 2 through 10 have a point value equal to their face value, and face cards (i.e., Jack, Queen and King) are worth 10 points. An Ace is worth 11 points unless it would bust a hand, in which case it is worth 1 point. Players play against the dealer and win by having a higher point total no greater than 21. If the player busts, the player loses, even if the dealer also busts. If the player and dealer have hands with the same point value, this is called a "push," and neither party wins the hand.

After the initial bets are placed, the dealer deals the cards, either from one or more, but typically two, hand-held decks of cards, or from a "shoe" containing multiple decks of cards, generally at least four decks of cards, and typically many more. A game in which the deck or decks of cards are hand-held is known as a "pitch" game. "Pitch" games are generally not played in casinos. When playing with more than one deck, the decks are shuffled together in order to make it more difficult to remember which cards have been dealt and which have not. The dealer deals two cards to each player and to himself. Typically, one of the dealer's two cards is dealt face-up so that all players can see it, and the other is face down. The face-down card is called the "hole card." In a European variation, the "hole card" is dealt after all the players' cards are dealt and their hands have been played. The players' cards are dealt face up from a shoe and face down if it is a "pitch" game.

A two-card hand with a point value of 21 (i.e., an Ace and a face card or a 10) is called a "Blackjack" or a "natural" and wins automatically. A player with a "natural" is conventionally paid 3:2 on his bet, although in 2003 some Las Vegas casinos began paying 6:5, typically in games with only a single deck.

Once the first two cards have been dealt to each player and the dealer, the dealer wins automatically if the dealer has a "natural" and the player does not. If the player has a "natural" and the dealer does not, the player automatically wins. If the dealer and player both have a "natural," neither party wins the hand.

If neither side has a "natural," each player completely plays out their hand; when all players have finished, the dealer plays his hand.

The playing of the hand typically involves a combination of four possible actions "hitting," "standing," "doubling down," or "splitting" his hand. Often another action called "surrendering" is added. To "hit" is to take another card. To "stand" is to take no more cards. To "double down" is to double the wager, take precisely one more card and then "stand." When a player has identical value cards, such as a pair of 8s, the player can "split" by placing an additional wager and playing each card as the first card in two new hands. To "surrender" is to forfeit half the player's bet and give up his hand. "Surrender" is not an option in most casino games of Blackjack. A player's turn ends if he "stands," "busts" or "doubles down." If the player "busts," he loses even if the dealer subsequently busts. This is the house advantage.

After all players have played their hands, the dealer then reveals the dealer's hole card and plays his hand. According to house rules (the prevalent casino rules), the dealer must hit until he has a point total of at least 17, regardless of what the players have. In most casinos, the dealer must also hit on a "soft" 17 (e.g., an Ace and 6). In a casino, the Blackjack table felt is marked to indicate if the dealer hits or stands on a soft 17. If the dealer busts, all remaining players win. Bets are normally paid out at odds of 1:1.

Four of the common rule variations are one card split Aces, early surrender, late surrender and double-down restrictions. In the first variation, one card is dealt on each Ace and the player's turn is over. In the second, the player has the option to surrender before the dealer checks for Blackjack. In the third, the player has the option to surrender after the dealer checks for Blackjack. In the fourth, doubling-down is only permitted for certain card combinations.

Insurance

Insurance is a commonly-offered betting option in which the player can hedge his bet by wagering that the dealer will win the hand. If the dealer's "up card" is an Ace, the player is offered the option of buying Insurance before the dealer checks his "hole card." If the player wishes to take Insurance, the player can bet an amount up to half that of his original bet. The Insurance bet is placed separately on a special portion of the table, which is usually marked with the words "Insurance Pays 2:1." The player buying Insurance is betting that the dealer's "hole card" is one with a value of 10 (i.e., a 10, Jack, Queen or King). Because the dealer's up card is an Ace, the player who buys Insurance is betting that the dealer has a "natural."

If the player originally bets $10 and the dealer shows an Ace, the player can buy Insurance by betting up to $5. Suppose the player makes a $5 Insurance bet and the player's hand with the two cards dealt to him totals 19. If the dealer's hole card is revealed to be a 10 after the Insurance betting period is over (the dealer checks for a "natural" before the players play their hands), the player loses his original $10 bet, but he wins the $5 Insurance bet at odds of 2:1, winning $10 and therefore breaking even. In the same situation, if the dealer's hole card is not one with a value of ten, the player immediately loses his $5 Insurance bet. But if the player chooses to stand on 19, and if the dealer's hand has a total value less than 19, at the end of the dealer's turn, the player wins his original $10 bet, making a net profit of $5. In the same situation, if the dealer's hole card is not one with a value of ten, again the player will immediately loser their $5 Insurance bet, and if the dealer's hand has a total value greater than the player's at the end of both of their turns, for example the player stood on 19 and the dealer ended his turn with 20, the player loses both his original $10 bet and his $5 Insurance bet.

Basic Strategy

As in all casino games, the house has a statistical advantage over the players so that the house nets a predictable percentage over an infinite number of hands, and gets closer to that percentage as the number of hands approaches infinity. However, unlike games in which the player makes no decisions except with respect to the bet, Blackjack players can reduce the casino advantage by several means, the most elementary of which is "basic strategy." "Basic strategy" is simply something that exists as a matter of general practice; it has no official sanction. The "basic strategy" determines when to hit and when to stand, as well as when doubling down or splitting in the best course. Basic strategy is based on the player's point total and the dealer's visible card. Under the most favorable conditions (i.e., playing with a single deck according to downtown Las Vegas rules) the house advantage over a player using basic strategy can be as low as 0.16%. Casinos offering options like surrender and double-after-split may be giving the player using basic strategy a statistical advantage and instead rely on players making mistakes to provide a house advantage.

A number of optional rules can benefit a skilled player, for example: if doubling down is permitted on any two-card hand other than a natural; if "doubling down" is permitted after splitting; if early surrender (forfeiting half the bet against a face or Ace up card before the dealer checks for Blackjack) is permitted; if late surrender is permitted; if re-splitting Aces is permitted (splitting when the player has more than two cards in their hand, and has just been dealt a second ace in their hand); if drawing more than one card against a split Ace is permitted; if five or more cards with a total no more than 21 is an automatic win (referred to as "Charlies").

Other optional rules can be detrimental to a skilled player. For example: if a "natural" pays less than 3:2 (e.g., Las Vegas Strip single-deck Blackjack paying out at 6:5 for a "natural"); if a hand can only be split once (is re-splitting possible for other than aces); if doubling down is restricted to certain totals (e.g., 9–11 or 10–11); if Aces may not be re-split; if the rules are those of "no-peek" (or European) Blackjack, according to which the player loses hands that have been split or "doubled down" to a dealer who has a "natural'(because the dealer does not check for this automatically winning hand until the players had played their hands); if the player loses ties with the dealer, instead of pushing where neither the player or the dealer wins and the player retains their original bet.

Card Counting

Unlike casino games like roulette and craps, in which one play has no influence on any subsequent play, a hand of Blackjack removes those cards from the deck. As cards are removed from the deck, the probability of each of the remaining cards being dealt is altered (and dealing the same cards becomes impossible). If the remaining cards have an elevated proportion of 10-value cards and Aces, the player is more likely to be dealt a natural, which is to the player's advantage (because the dealer wins even money when the dealer has a natural, while the player wins at odds of 3:2 when the player has a natural). If the remaining cards have an elevated proportion of low-value cards, such as 4s, 5s and 6s, the player is more likely to bust, which is to the dealer's advantage (because if the player busts, the dealer wins even if the dealer later busts).

The house advantage in Blackjack is relatively small at the outset. By keeping track of which cards have been dealt, a player can take advantage of the changing proportions of the remaining cards by betting higher amounts when there is an elevated proportion of 10-value cards and Aces and by better lower amounts when there is an elevated proportion of low-value cards. Over time, the deck will be unfavorable to the player more often than it is favorable, but by adjusting the amounts that he bets, the player can overcome that inherent disadvantage. The player can also use this information to refine basic strategy. For instance, basic strategy calls for hitting on a 16 when the dealer's up card is a 10, but if the player knows that the deck has a disproportionately small number of low-value cards remaining, the odds may be altered in favor of standing on the 16.

There are a number of card-counting schemes, all dependent for their efficacy on the player's ability to remember either a simplified or detailed tally of the cards that have been played. The more detailed the tally, the more accurate it is, but the harder it is to remember. Although card counting is not illegal, casinos will eject or ban successful card counters if they are detected.

Shuffle tracking is a more obscure, and difficult, method of attempting to shift the odds in favor of the player. The player attempts to track groups of cards during the play of a multi-deck shoe, follow them through the shuffle, and then looks for the same group to reappear from the new shoe, playing and betting accordingly.

Casino Countermeasures

The basic method of thwarting card counters is to use a large number of decks. Shoes containing 6 or 8 decks are common. The more cards there are, the less variation there is in the proportions of the remaining cards and the harder it is to count them. The player's advantage can also be reduced by shuffling the cards more frequently, but this reduces the amount of time that can be devoting to actual play and therefore reduces the casino profits. Some casinos now use shuffling machines, some of which shuffle one set of cards while another is in play, while others continuously shuffle the cards. The distractions of the gaming floor environment and complimentary alcoholic beverages also act to thwart card counters. The simplest way of thwarting card counting is the inferior Blackjack payoff of 6:5, which even with a single deck is statistically much more disadvantageous to the player than standard 3:2 Blackjack.

SUMMARY OF THE INVENTION

The present invention is an option that a player can buy while playing the card game of Blackjack. Alternatively, one can think of the present invention as a modified method of playing the game of blackjack that provides a player with an additional method for adding to the point value of their hand other than by receiving cards from the deck or shoe.

In the simplest form of the invention, once a player has chosen to not receive any more cards, the player then decides whether they will try to add to the point value of their hand by a predetermined alternate means. The predetermined alternate means is by randomly generating a number from a limited set of numbers.

Preferably, the ability to add to the hand from the limited set of numbers can only take place one time.

Preferably, the highest value that can be added from the random set of numbers is less than 11.

More, preferably, the set is from 1 to 6.

Preferably, the random number generator is a typical six-sided die that has equal probability over an infinite time of landing on any one of its sides as much as any other.

The present invention is preferably played with players wagering on their hands. In the preferred embodiment, the present invention of allowing a player to add to their point value of their hand by alternate means would be a kind of "option" that a dealer, or the house or casino would offer players for a fee during the initial betting and prior to the start of the play.

In the preferred embodiment, the house or dealer is not allowed to add to the point value of their hand by the alternate method offered to the players.

In the preferred embodiment, if players decide to try to add to their hand, players roll a single die and the outcome, a number between one and six, inclusive, is added to the total point value of the player's cards.

In the most preferred embodiment of the invention, giving the players the ability to add to the point value of their hand reduces the odds "advantage" of the dealer or house. The cost of the fee for the players is accordingly set to recoup some, all or more of the odds advantage given to the player. For a dealer or house that wanted to recoup more than all of the odds advantage given, the cost of the fee would be preferably 20 percent of the player's original wager.

In the preferred embodiment of the present invention, the game of BlackJack is first modified by giving players the option to purchase the option to add to their hand by the alternate method. If the player does elect to buy the option of the present invention, the cards are dealt in the usual manner of Blackjack and the player plays the hand as he chooses. Once the player is finished, according to the preferred embodiment of the present invention the player may roll a single die and the outcome, a number between one and six, inclusive, is added to the total point value of the player's cards.

An object of the present invention is to provide an option that a player can buy while playing the card game of Blackjack.

A further object of the present invention is to add variety to the card game of Blackjack by providing an additional option.

A further object of the present invention is to provide an option that lessens the odds of busting a player's hand in the card game of Blackjack.

A further object of the present invention is to provide an option that increases the popularity of the card game of Blackjack, particularly among novice players.

A further object of the present invention is to provide an option in the card game of Blackjack that provides a favorable edge to the dealer.

DETAILED DESCRIPTION OF THE INVENTION

Figure 1:
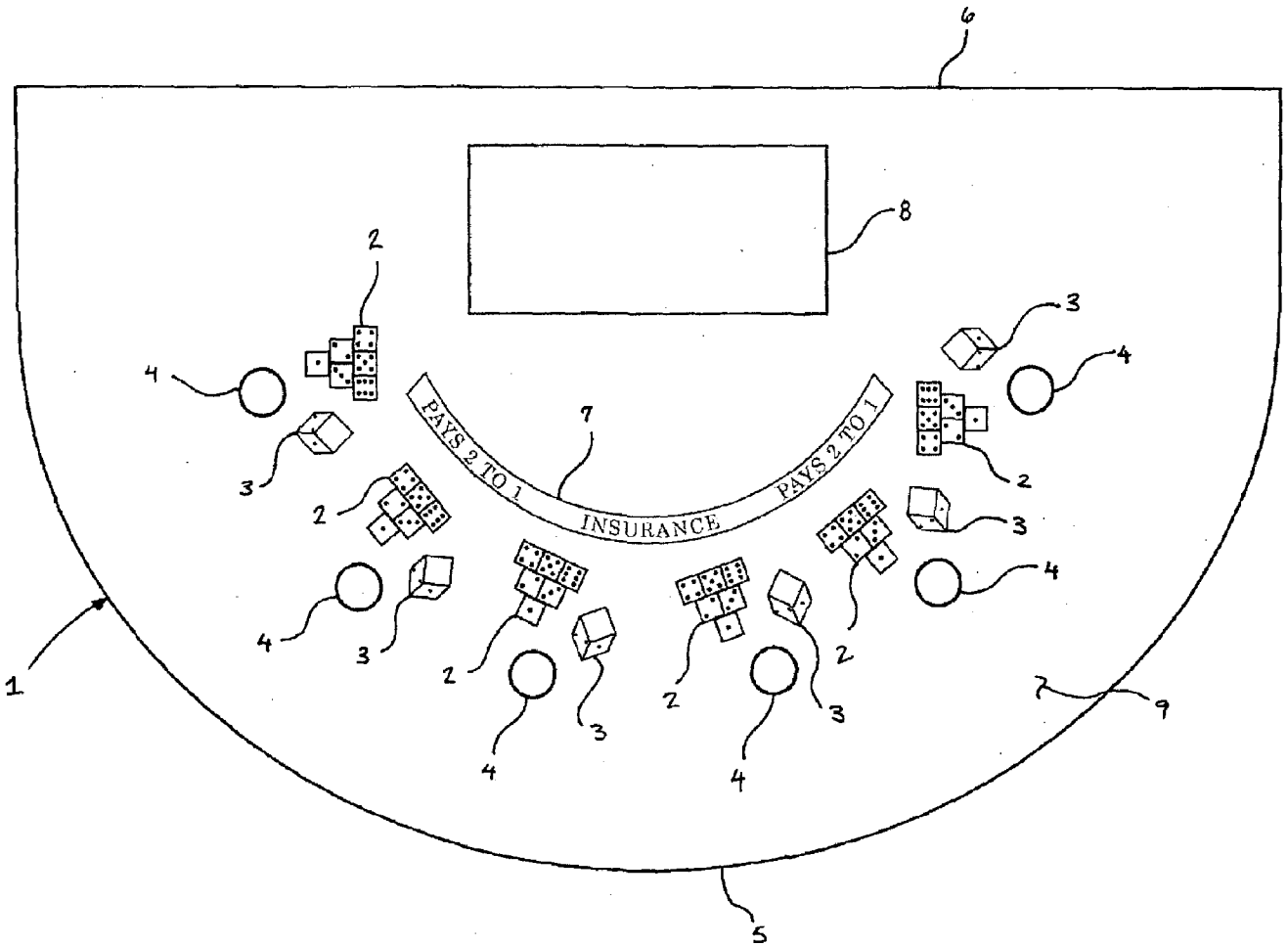
FIG. 1 is a plan view of a gaming table designed to accommodate casino play of the present invention.

The present invention is an option (see summary of the invention above) that a player can buy while playing the casino card game of Blackjack. The following description and analysis assume that the Blackjack game uses two decks of cards, the dealer hits on soft 17, any pair except a pair of Aces can be split up to three times (for a total of four hands), a pair of Aces can only be split once and receive only one additional card on each of the two split Aces, doubling down is allowed on any two-card hand, and doubling down after splitting is allowed. Although these are the assumptions used in the description and analysis, the option of the present invention can be used in any game of Blackjack.

In the preferred embodiment, the option of the present invention must be bought before any cards are dealt and the fee is preferably 20 percent of the player's original wager. In other words, if the player originally wagers five dollars, the option of the present invention costs one dollar. The option of the present invention is preferably optional, and a player can preferably play Blackjack without the option of the present invention at any table offering the option of the present invention. However, it would be possible to make the option of the present invention mandatory and therefore not truly an option. Also, the percentage of the original wager could be different, variable, or the fee could be not linked to the amount of the original wager, although none of these are preferred.

If the player does elect to buy the option of the present invention, the cards are dealt in the usual manner of Blackjack and the player plays the hand as he chooses. Once the player is finished, according to the present invention the player may roll a single die and the outcome, a number between one and six, inclusive, is added to the total point value of the player's cards. For example, if the player stood on 15 and then chose to roll, the player's total could be any number from 16 to 21. Since player busts are the only advantage that the casino has over the player in Blackjack, the option of the present invention provides a substantial advantage to the player.

Preferably, if a player doubles down, the player loses the option of rolling the die and the option fee is forfeited. Alternatively, the fee could be refunded, but for a casino this is not preferred.

Preferably, if the player splits a pair, the player can exercise the roll option on all split hands for no additional fee. However, if the split pair is a pair of Aces, the player's fee is preferably refunded because each Ace receives only one additional card.

Although the present invention is preferably played with real cards, a real table a human dealer and human players, all or some of the elements of this game can be represented, or mediated, by a computer, with or without a video display.

Most preferably, the game of the present invention is played on a felt-topped table 1 layed out as shown in FIG. 1. The felt 9 is preferably marked with inverted pyramids 2 in the form of stacked two-dimensional die sides where the die roll results are marked either by placing either a separate marker, preferably the chip or chips used to pay the option fee, or the die itself on the value of the die roll. If additional die rolls are made, for instance for split hands, additional separate markers will be placed, preferably by the dealer, on the same inverted pyramid 2. The felt 9 is also preferably marked with a three-dimensional representation 3 of a die with the uppermost side blank, and the die roll fee is preferably placed there. There is preferably a circle 4 marked on the felt 9 for placement of wagers. Furthermore, the felt 9 is preferably marked with a curved line 7 marked with the words "Pays 2 to 1" and "Insurance." Preferably, there is an area 8 where the dealer's cards are placed. The table 1 preferably has a straight side 6 behind which the dealer stands and a curved side 5 behind which the players sit. Most preferably, the table 1 is 70 inches long and 42 inches wide at its greatest width.

Playing Strategy

Since the player makes decisions in Blackjack, an ideal, optimum playing strategy for a player must be determined, and then entered as an assumption in the calculation for determining the house edge in Blackjack that incorporates the option of the present invention. To that end, Donald Caitlin of Amherst, Mass., a mathematician with experience analyzing games of chance for both individuals and gaming companies, wrote a computer program that calculates the player's expected returns in the various alternatives faces in Blackjack that incorporates the option of the present invention.

An infinite deck approximation was used and close calls (situations in which the odds of winning are close and, therefore, hard to call) were checked using simulation. The possibility of splitting was assumed for all pairs.

The player's optimum playing strategy in terms of the next specific action they should take under the modified game of the preferred embodiment of the present invention is detailed in the following 4 tables. That is to say, the following tables instruct a player to either hit, stand, double down their bet, or split their bet on the basis that the particular action will lead to their eventually beating or pushing with the dealer. The tables are to be used as an iterative manner, until the player reaches "stand" or "roll".

The first table deals with "hard" hand when no aces are present:

TABLE 1

"Hard" Hand Hit/Stand/Roll/Double Strategy

| Player's Total | Dealer's Up Card 2 | 3 | 4 | 5 | 6 | 7 | 8 | 9 | T | A |
|---|---|---|---|---|---|---|---|---|---|---|
| 21 | STD | STD | STD | STD | STD | STD | STD | STD | STD | STD |
| 20 | STD | STD | STD | STD | STD | STD | STD | STD | STD | STD |
| 19 | STD | STD | STD | STD | STD | STD | STD | STD | STD | STD |
| 18 | STD | STD | STD | STD | STD | STD | STD | ROL | STD | ROL |
| 17 | ROL | ROL | ROL | ROL | ROL | ROL | ROL | ROL | ROL | ROL |
| 16 | ROL | ROL | ROL | ROL | ROL | ROL | ROL | ROL | ROL | ROL |
| 15 | ROL | ROL | ROL | ROL | ROL | ROL | ROL | ROL | ROL | ROL |
| 14 | ROL | ROL | ROL | ROL | ROL | ROL | ROL | ROL | ROL | ROL |
| 13 | ROL | ROL | ROL | ROL | ROL | ROL | ROL | ROL | ROL | ROL |
| 12 | ROL | ROL | ROL | ROL | ROL | HIT | HIT | HIT | HIT | HIT |
| 11 | DBL | DBL | DBL | DBL | DBL | HIT | HIT | HIT | HIT | HIT |
| 10 | DBL | DBL | DBL | DBL | DBL | HIT | HIT | HIT | HIT | HIT |
| 9 | HIT | HIT | HIT | HIT | DBL | HIT | HIT | HIT | HIT | HIT |
| 8 | HIT | HIT | HIT | HIT | HIT | HIT | HIT | HIT | HIT | HIT |
| 7 | HIT | HIT | HIT | HIT | HIT | HIT | HIT | HIT | HIT | HIT |
| 6 | HIT | HIT | HIT | HIT | HIT | HIT | HIT | HIT | HIT | HIT |
| 5 | HIT | HIT | HIT | HIT | HIT | HIT | HIT | HIT | HIT | HIT |
| 4 | HIT | HIT | HIT | HIT | HIT | HIT | HIT | HIT | HIT | HIT |

Hit(HIT)/Stand (STD)/Roll (ROL)/Double (DBL)

The strategy above works at any point in the playing of the hand, with the exception that once the player has three cards in his hand, then the situations marked DBL are interpreted as HIT.

It should be noted that the big change is that doubling strategy here is much less aggressive than the usual Basic Strategy. This is due to the fact that, if the dealer has a potentially good hand (7 to Ace up), then the player can either hit into a good hand or hit into a "stiff" hand (if a player's first cards total 12–16, it is a "stiff" hand [one than can be busted with a hit]; if the dealer's up card is a 2–6, it is a "stiff" hand for the dealer; if a player has 17 or better it is a "pat" hand; if the dealer shows a 7-Ace, it consider is considered a "pat" hand for the dealer) and then roll into a possibly good hand.

TABLE 2

"Soft" Hand Hit/Stand/Roll/Double/Split Strategy for Three or More Cards

| Player's Total | Dealer's Up Card 2 | 3 | 4 | 5 | 6 | 7 | 8 | 9 | T | A |
|---|---|---|---|---|---|---|---|---|---|---|
| 21 | STD | STD | STD | STD | STD | STD | STD | STD | STD | STD |
| 20 | STD | STD | STD | STD | STD | STD | STD | STD | STD | STD |
| 19 | STD | STD | STD | STD | STD | STD | STD | STD | STD | STD |
| 18 | HIT | HIT | HIT | DBL | DBL | STD | HIT | HIT | ROL | HIT |
| 17 | ROL | ROL | ROL | ROL | ROL | ROL | ROL | ROL | ROL | ROL |
| 16 | ROL | ROL | ROL | ROL | ROL | ROL | ROL | ROL | HIT | ROL |
| 15 | ROL | ROL | ROL | ROL | ROL | ROL | HIT | HIT | HIT | HIT |
| 14 | HIT | HIT | HIT | HIT | HIT | HIT | HIT | HIT | HIT | HIT |
| 13 | HIT | HIT | HIT | HIT | HIT | HIT | HIT | HIT | HIT | HIT |
| 12 | SPL | SPL | SPL | SPL | SPL | SPL | SPL | SPL | SPL | SPL |

Hit (HIT)/Stand (STD)/Roll (ROL)/Double (DBL)/Split (SPL)

TABLE 3

"Soft" Hand Hit/Stand/Roll/Double/Split Strategy for Two Cards

| Player's Total | Dealer's Up Card 2 | 3 | 4 | 5 | 6 | 7 | 8 | 9 | T | A |
|---|---|---|---|---|---|---|---|---|---|---|
| 21 | STD | STD | STD | STD | STD | STD | STD | STD | STD | STD |
| 20 | STD | STD | STD | STD | STD | STD | STD | STD | STD | STD |

TABLE 3-continued

"Soft" Hand Hit/Stand/Roll/Double/Split Strategy for Two Cards

| | Dealer's Up Card | | | | | | | | | |
|---|---|---|---|---|---|---|---|---|---|---|
| | 2 | 3 | 4 | 5 | 6 | 7 | 8 | 9 | T | A |
| 19 | STD | STD | STD | STD | DBL | STD | STD | STD | STD | STD |
| 18 | HIT | HIT | HIT | DBL | DBL | STD | HIT | HIT | ROL | HIT |
| 17 | ROL | ROL | ROL | ROL | ROL | ROL | ROL | ROL | ROL | ROL |
| 16 | ROL | ROL | ROL | ROL | ROL | ROL | ROL | ROL | HIT | ROL |
| 15 | ROL | ROL | ROL | ROL | ROL | ROL | HIT | HIT | HIT | HIT |
| 14 | HIT | HIT | HIT | HIT | HIT | HIT | HIT | HIT | HIT | HIT |
| 13 | HIT | HIT | HIT | HIT | HIT | HIT | HIT | HIT | HIT | HIT |
| 12 | SPL | SPL | SPL | SPL | SPL | SPL | SPL | SPL | SPL | SPL |

Hit (HIT)/Stand (STD)/Roll (ROL)/Double (DBL)/Split (SPL)

As in the "hard" hands, the doubling strategy for "soft" hands in Blackjack that incorporates the option of the present invention is much less aggressive than in normal Basic Strategy play. Doubling of the "soft" 19 versus the dealer's 6 is a close call and could be ignored if so desired.

TABLE 4

Splitting Strategy

| | Dealer's Up Card | | | | | | | | | |
|---|---|---|---|---|---|---|---|---|---|---|
| | 2 | 3 | 4 | 5 | 6 | 7 | 8 | 9 | T | A |
| Player's Pair | | | | | | | | | | |
| T—T | STD | SPL | SPL | SPL | SPL | SPL | STD | STD | STD | STD |
| 9—9 | SPL | SPL | SPL | SPL | SPL | SPL | SPL | SPL | SPL | SPL |
| 8—8 | SPL | SPL | SPL | SPL | SPL | SPL | SPL | ROL | ROL | ROL |
| 7—7 | SPL | SPL | SPL | SPL | SPL | SPL | SPL | SPL | SPL | SPL |
| 6—6 | SPL | SPL | SPL | SPL | SPL | SPL | SPL | SPL | SPL | SPL |
| 5—5 | SPL | SPL | SPL | SPL | SPL | SPL | HIT | HIT | HIT | HIT |
| 4—4 | SPL | SPL | SPL | SPL | SPL | SPL | SPL | HIT | HIT | HIT |
| 3—3 | SPL | SPL | SPL | SPL | SPL | SPL | HIT | HIT | HIT | HIT |
| 2—2 | SPL | SPL | SPL | SPL | SPL | SPL | SPL | HIT | HIT | HIT |
| A—A | SPL | SPL | SPL | SPL | SPL | SPL | SPL | SPL | SPL | SPL |

Hit (HIT)/Stand (STD)/Split (SPL)/Ten-value card (T)

Splitting strategy in Blackjack that incorporates the option of the present invention is very aggressive. Splitting fives versus the dealer's 2 through 7 is unheard of in normal Blackjack but here a 15 is a good hand against a dealer's possible stiff. Also, one always splits 6s and 7s since 12 and 14 are not very good hands in this game but 16 and 17 are.

If the above-outlined strategy is not published, players probably will not play this game optimally. Although this may appear superficially advantageous to the casino, it may act as a disincentive to playing the game if players lose too often. It is recommended that a strategy chart be made available to players.

House Advantage

The house advantage for Blackjack that incorporates the option of the present invention was determined by a computer simulation program. The program plays Blackjack according to the following rules: the Blackjack game uses two decks of cards, the dealer hits on soft 17, any pair except a pair of Aces can be split up to three times (for a total of four hands), a pair of Aces can only be split once and receive only one additional card on each of the two split Aces, doubling down is allowed on any two-card hand, and doubling down after splitting is allowed. The program played 500 million hands and kept track of the player's losses (including the fee to take the option of the present invention). The results are listed in the following table:

TABLE 5

| Trials | Total Bet | Total Lost |
|---|---|---|
| 500,000,000 | $572,417,222.00 | $13,386,482.00 |

Dividing the total lost by the 500 million in ante bets shows that the house edge based on the ante is approximately 2.68 percent. The house edge based on the total amount bet is the total lost divided by the total amount bet and is approximately 2.34 percent.

Conclusion

The option of the present invention is an interesting side option for Blackjack players and carries an adequate house advantage of 2.68 percent based on the ante. It is relatively unlikely that seasoned Blackjack players would avail themselves of this option (because it is both unfamiliar and because the house advantage is greater than Blackjack played without it), but novice players would find it attractive because of frustration with frequently busted hands and the desire to break the monotony of normal Blackjack. This conclusion is supported by the data obtained from the simulation and displayed in the following table:

TABLE 6

| Total Hands | Busted |
|---|---|
| 550,960,785 | 37,024,936 |

The data in Table 6 show that the bust rate for Blackjack that incorporates the option of the present invention is 6.72 percent. This data includes split hands. For a normal Blackjack game using otherwise identical rules but without the option of the present invention, the bust rate is approximately 15.68 percent.

I claim:

1. A method of playing a hand of the card game Blackjack wherein a player places a primary bet, accumulates cards and creates one or more hands, stops at a selected point in receiving cards in each hand, such that adding the point values of the cards in a given hand creates a numerical total of the player's cards in that hand, the desired goal being that the numerical total of the player's cards is higher than a total numerical point value of a dealer's cards, but not greater than a total numerical point value of twenty-one, the improvement comprising:

a. allowing the player to pay a fee in addition to the primary bet, both the primary bet and the fee being placed before any cards are dealt;

b. allowing the player to accumulate cards to make one or more hands;

c. if the player has paid the fee, allowing the player to roll a single six-sided die after all of the player's cards are accumulated for a hand as customary in the card game Blackjack;

d. adding the numerical point value of the die roll outcome to the numerical total of the player's cards to arrive at the total numerical point value for the player's hand;

e. comparing the total numerical point value for the player's hand to the total numeric point value of the dealer's cards; and f. paying out to the player if the total numerical point value of the player's cards in the hand is higher than a total numerical point value of the dealer's cards, but not greater than a total numerical point value of twenty-one.

2. The method of claim 1 wherein:

a. the fee is equal to twenty percent of the primary bet.

3. The method of claim 1 wherein:

a. the player doubles down, the player loses the option of rolling the die and the player's option fee is forfeited.

4. The method of claim 1 wherein:

a. the players doubles down, and the player's option fee is refunded.

5. The method of claim 1 wherein:

a. the player receive a pair of cards, the player splits the pair to form two hands in which each card of the pair is the first card, and the player chooses to exercise the roll option on both of the split hands.

6. The method of claim 1 wherein:

a. the player receives a pair of Aces, the player splits the pair of Aces, and the player's option fee is refunded.

7. A method of playing a hand of the card game Blackjack wherein a player places a primary bet, accumulates cards and creates one or more hands, stops at a selected point in receiving cards in each hand, such that adding the point values of the cards in a given hand creates a numerical total of the player's cards in that hand, the desired goal being that the numerical total of the player's cards is higher than a total numerical point value of a dealer's cards, but not greater than a total numerical point value of twenty-one, the improvement comprising:

a. requiring the player to pay a fee in addition to the primary bet, both the primary bet and the fee being placed before any cards are dealt;

b. allowing the player to accumulate cards to make one or more hands;

c. requiring the player to roll a single six-sided die after all of the player's cards are accumulated as customary in the card game Blackjack;

d. adding the numerical point value of the die roll outcome to the numerical total of the player's cards to arrive at the total numerical point value for the player's hand;

e. comparing the total numerical point value for the player's hand to the total numeric point value of the dealer's cards; and f. paying out to the player if the total numerical point value of the player's cards in the hand is higher than a total numerical point value of the dealer's cards, but not greater than a total numerical point value of twenty-one.

8. A method of playing a hand of the card game Blackjack wherein a player places a primary bet, accumulates cards and creates one or more hands, stops at a selected point in receiving cards in each hand, such that adding the point values of the cards in a given hand creates a numerical total of the player's cards in that hand, the desired goal being that the numerical total of the player's cards is higher than a total numerical point value of a dealer's cards, but not greater than a total numerical point value of twenty-one, the improvement comprising:

a. allowing the player to roll a single six-sided die after all of the player's cards are accumulated as customary in the card game Blackjack;

b. adding the numerical point value of the die roll outcome to the numerical total of the player's cards to arrive at the total numerical point value for the player's hand;

c. comparing the total numerical point value for the player's hand to the total numeric point value of the dealer's cards; and d. paying out to the player if the total numerical point value of the player's cards in the hand is higher than a total numerical point value of the dealer's cards, but not greater than a total numerical point value of twenty-one.

9. A method of playing a card game of wherein:

a. a dealer deals a plurality of hands of one or more cards from one or more decks of cards, at least one of the hands of cards going to each of the dealer and one or more players;

b. each of the cards has at least one point value between 1 and 11, inclusive;

c. the point value of a hand is the sum of the point values of the cards that comprise the hand;

d. each player has the option of adding to the point value of the cards in their hand by a means of generating a random number other than dealing a card;

e. one or more players exercise the option of adding to the point value of the cards in their hand by a means of generating a random number other than dealing a card;

f. the point value of each hand is calculated;

g. if the point value of a player's hand is greater than the point value of the dealer's hand, and less than or equal to a preselected number, the player's hand is deemed to be a winning hand; and h. if the point value of a player's hand is less than the point value of the dealer's hand, and the point value of the dealer's hand is less than or equal to a preselected number, the dealer's hand is deemed to be a winning hand.

10. The method of claim 9, wherein:

a. the means of generating a random number other than dealing a card is the rolling of one or more dice.

11. The method of claim 10, wherein:

a. the means of generating a random number other than a card dealt by the dealer is the rolling of one die.

12. The method of claim 11, wherein:

a. the die is a six-sided die that has equal probability over an infinite time of landing on any one of its sides as much as any other.

13. The method of claim 12, wherein:

a. the rolling of one die generates a point value between 1 and 6, inclusive.

14. The method of claim 13, wherein:

a. the preselected number is 21.

15. The method of claim 14, wherein:

a. an Ace has a point value of 11 if the point value of the hand including the Ace with a point value of 11 is 21 or less; and b. an Ace has a point value of 1 if the point value of the hand including the Ace with a point value of 11 is over 21.

16. The method of claim 15, wherein:

a. a ten has a numerical point value of 10;

b. a Jack has a numerical point value of 10;

c. a Queen has a numerical point value of 10; and d. a King has a numerical point value of 10.

17. The method of claim 16, wherein:

a. each of the one or more players that exercises the option to generate a random number other than dealing a card pays a fee to exercise the option to generate a random number other than dealing a card.

18. The method of claim 17, wherein:

a. each of the one or more players wagers money on their hand.

19. The method of claim 18, wherein:

a. the dealer pays back the wager placed and an additional amount to each player deemed to have a winning hand.

20. The method of claim 19, wherein:

a. the dealer does not have the option to generate a random number other than dealing a card.

* * * * *